US007416183B2

(12) United States Patent
Beckstrom et al.

(10) Patent No.: US 7,416,183 B2
(45) Date of Patent: Aug. 26, 2008

(54) POSTAL WEIGHING PLATFORM WITH INTEGRATED FEEDING AND DESKEWING FUNCTIONS

(75) Inventors: David W. Beckstrom, Milford, CT (US); John P. Miller, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 368 days.

(21) Appl. No.: 11/145,588

(22) Filed: Jun. 6, 2005

(65) Prior Publication Data

US 2006/0284367 A1 Dec. 21, 2006

(51) Int. Cl.
*B65H 9/16* (2006.01)

(52) U.S. Cl. ..... 271/250; 271/251; 271/252; 271/2

(58) Field of Classification Search ..... 271/2, 271/250, 251, 252
See application file for complete search history.

(56) References Cited

U.S. PATENT DOCUMENTS 4,398,709 A * 8/1983 Janssen et al. ..... 271/10.12
4,448,407 A * 5/1984 Bashford et al. ..... 271/228
4,776,579 A * 10/1988 Romand et al. ..... 271/228
5,064,186 A * 11/1991 Westover ..... 271/188
5,723,825 A 3/1998 Dolan et al. ..... 177/145
5,767,452 A * 6/1998 Yankloski ..... 177/25.11
6,343,686 B1 * 2/2002 Whiting et al. ..... 198/379
6,811,152 B2 * 11/2004 Delfosse et al. ..... 271/225
2002/0079636 A1 * 6/2002 Riccardi ..... 271/3.15

* cited by examiner

*Primary Examiner*—Patrick Mackey
*Assistant Examiner*—Howard Sanders
(74) *Attorney, Agent, or Firm*—Brian A. Lemm; Angelo N. Chaclas

(57) ABSTRACT

The present invention includes apparatus and methods for handling mailpieces. A mailpiece handling device includes a substantially horizontal deck for receiving a mailpiece. The device also includes a substantially vertical registration wall that extends upwardly from an edge of the deck. The device further includes a disk mounted for rotation in a circular opening in the deck adjacent the registration wall. The disk has a substantially horizontal surface. In addition, the device includes an arm mounted above the disk so as to be pivotable in a horizontal direction. Also, the device includes a steering member mounted at a free end of the arm. The steering member is for applying downward pressure to a mailpiece that is in contact with the disk.

5 Claims, 8 Drawing Sheets

POSTAL WEIGHING PLATFORM WITH INTEGRATED FEEDING AND DESKEWING FUNCTIONS

BACKGROUND

This invention relates generally to the field of letter-handling equipment and more particularly to letter-feeding equipment.

In many small offices a postal scale and a small mailing machine/postage meter are used to prepare mailpieces for mailing. In a typical operation, the user places a letter on the postal scale and then takes the letter off the scale and inserts it into the infeed nip of the mailing machine. The postage meter is set to the correct amount of postage automatically in response to weight data transmitted to the postage meter from the scale. A sensor at the infeed end of the mailing machine senses the presence of the letter. The mailing machine responds to the sensor by feeding the letter through the meter, which prints a postage indicia on the letter.

If a considerable number of letters are to be mailed at a given time, the labor involved in placing the letter on the scale and then manually feeding it into the mailing machine/postage meter may become burdensome. However, in many cases, the volume of mail does not justify acquisition of high-speed integrated mailing equipment. It would therefore be desirable to provide further automation of the process of weighing/metering mailpieces without requiring the expenditure entailed by high-speed mailing equipment.

SUMMARY

Accordingly, an improved apparatus and method for handling a mailpiece is provided. A mailpiece handling device according to some embodiments includes a substantially horizontal deck for receiving a mailpiece and a substantially vertical registration wall which extends upwardly from an edge of the deck. The mailpiece handling device further includes a disk mounted for rotation in a circular opening in the deck adjacent the registration wall. The disk has a substantially horizontal surface. The mailpiece handling device also includes an arm mounted above the disk so as to be pivotable in a horizontal direction, and a steering member mounted at a free end of the arm. The steering member is for applying downward pressure to a mailpiece that is in contact with the disk.

The mailpiece handling device may also include a first motor for rotating the disk and a servo motor for pivoting the arm. The mailpiece handling device may further include a control device coupled to the first motor and the servo motor to control the first motor and the servo motor. The control device may selectively control the first motor to selectively rotate the disk in a clockwise direction and in a counter-clockwise direction.

The mailpiece handling device may also include a plurality of sensors mounted in the deck. The sensors may be coupled to the control device to provide respective output signals to the control device. There may be three sensors in all, with one sensor located at one end of the registration wall and another sensor located at an opposite end of the registration wall.

The mailpiece handling device may also include a weighing apparatus which supports the deck and which is provided to weigh the mailpiece when the mailpiece is on the deck.

In another aspect, there is provided a method of handling a mailpiece. The method includes depositing a mailpiece on a deck. The deck has a circular opening formed therein and a disk mounted for rotation in the opening. The method also includes defining a nip between a steering member and the disk at a first circumferential location relative to the opening and later defining the nip between the steering member and the disk at a second circumferential location that is different from the first circumferential location.

The method may further include thereafter defining the nip at a third circumferential location. The disk may be rotated clockwise while the nip is defined at one of the locations and may be rotated counter-clockwise while the nip is defined at another of the locations. The mailpiece may be moved in one direction along the registration wall while the nip is defined at one of the locations and the mailpiece may be moved in the opposite direction along the registration wall while the nip is defined at another one of the locations. The mailpiece may be deposited on the deck by a user's hand or by a mechanical mailpiece handling device. The mailpiece may be weighed while it is on the deck.

In still another aspect, an apparatus includes a turntable and a pivotable arm mounted above the turntable. The pivotable arm has an axis of pivoting that substantially coincides with the axis of rotation of the turntable.

The apparatus may further include a deck in which the turntable is mounted. Also the apparatus may include a nip member mounted at a free end of the arm and in contact with the turntable to form a nip relative to the turntable. The nip member may be a roller.

The apparatus may further include a registration wall that extends upwardly along an edge of the deck. In addition, the apparatus may include at least one device for detecting the presence of an item on the deck.

Still further, the apparatus may include a mechanism for selectively rotating the turntable in a clockwise direction and in a counter-clockwise direction. Also, the apparatus may include a mechanism for weighing an item that is in contact with the turntable.

In another aspect, a mailpiece handling device includes a deck for receiving a mailpiece and a registration wall at an edge of the deck. The device further includes a transport mechanism for imparting movement to the mailpiece. The transport mechanism is operative to sequentially move the mailpiece in a first direction along the registration wall and in a second direction along the registration wall without changing the attitude of the mailpiece. The first direction is opposite to the second direction. As used herein and in the appended claims, "attitude" will be understood to mean the orientation of the mailpiece relative to its direction of motion.

The transport mechanism may include a nip mechanism that re-positions a nip that engages the mailpiece. The nip is re-positioned without changing the elevation of the nip relative to the deck.

In another aspect, a method includes releasing a mailpiece from a user's hand to deposit the mailpiece on a weighing scale platform. The method also includes automatically aligning the mailpiece with a registration wall while the mailpiece is on the platform. The method further includes weighing the mailpiece while the mailpiece is on the platform and automatically feeding the mailpiece from the platform to a postage meter. The aligning step may include automatically sensing that the mailpiece is on the platform.

In another aspect, a mailpiece de-skewing device includes a deck and a registration wall that extends upwardly from an edge of the deck. The device also includes a turntable mounted in the deck and a nip member for applying downward pressure to a mailpiece that is in contact with the turntable. The nip member forms a nip with the turntable. The nip is for moving the mailpiece to align the mailpiece with the registration wall. The nip member may be an idler roller.

In another aspect, a mailpiece handling device includes a deck for receiving mailpieces seriatim from another device. The mailpiece handling device also includes a registration wall that extends upwardly from an edge of the deck. The mailpiece handling device also includes a transport mechanism for imparting motion to the mailpieces to align the mailpieces with the registration wall and to offload the mailpieces from the deck in a first direction. The transport mechanism is selectively operative to offload mailpieces from the deck in a second direction that is different from the first direction.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

The present invention includes a weighing scale upon which a mailpiece may be deposited by, for example, a human operator. The scale platform includes a mailpiece-handling mechanism that aligns the mailpiece with a registration wall, and then feeds the mailpiece to a postage meter/printer after the mailpiece has been weighed. Thus, for a relatively low volume mailing operation, an increased degree of automation is provided for the process of weighing and metering single mailpieces.

The mailpiece handling mechanism may be constituted by a turntable or rotating disk that is mounted in the deck that forms the scale platform. A pivotable nip-arm carries a roller or other nip member that cooperates with the rotating disk to form a re-positionable nip that ingests and aligns the mailpiece, positions the mailpiece for weighing, and then feeds the mailpiece to the postage meter/printer.

In other embodiments, a similar mailpiece handling mechanism may be provided with or without weighing capabilities to serve as a mechanical interface to relay mailpieces, with proper alignment, from one mailpiece processing device to another.

Figure 1:
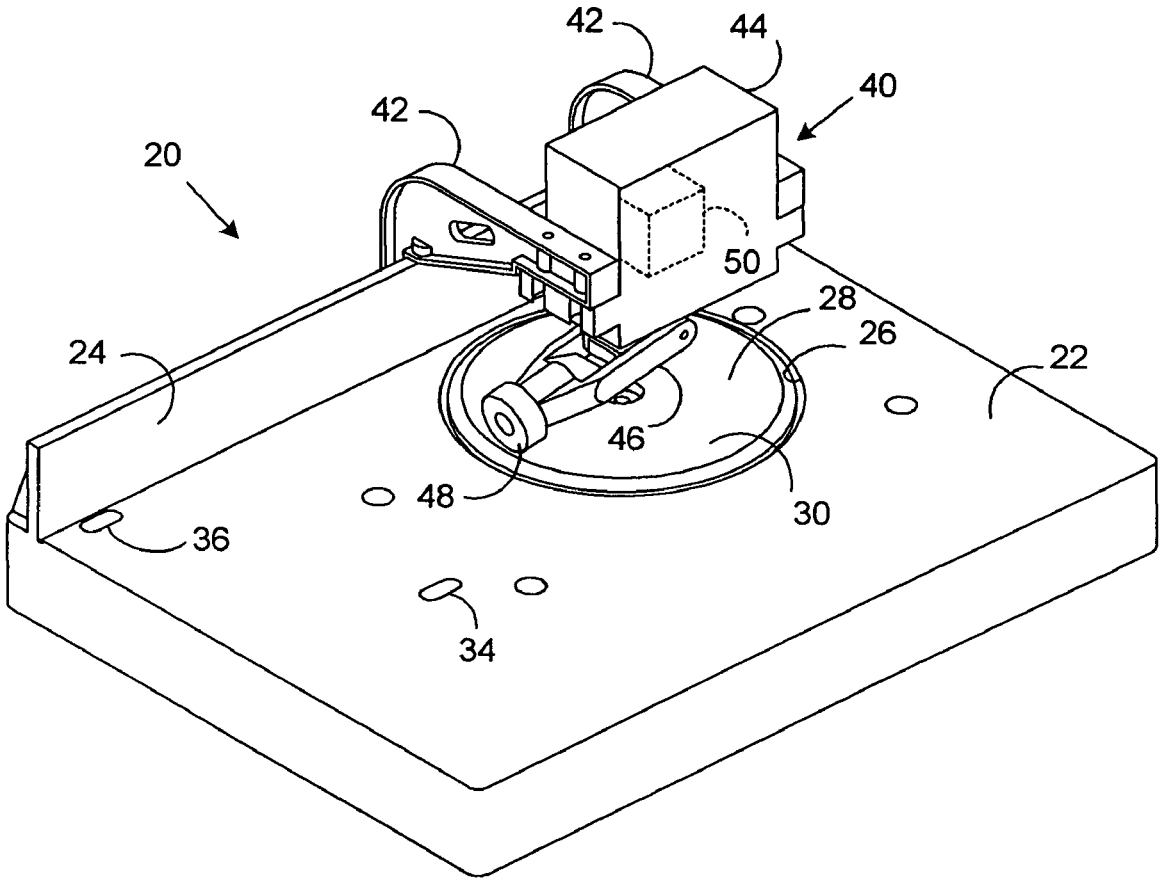
FIG. 1 is a perspective view of an upper portion of a mailpiece de-skewing/weighing/feeding device provided in accordance with the invention.

Referring now to the drawings, and particularly to FIG. 1, the reference numeral 20 indicates generally a mailpiece de-skewing/weighing/feeding device provided in accordance with the present invention. In FIG. 1, only the upper portion of the device 20 is shown, to particularly illustrate mailpiece handling capabilities of the device.

The device 20 includes a generally planar, rectangular and horizontal deck 22 that serves as a scale platform. The deck 22 is available to receive a single mailpiece that is to be weighed and then fed to an adjoining metering/printing unit, which is not shown in FIG. 1. A substantially vertical registration wall 24 is provided along a rear edge of the deck 22 and extends upwardly therefrom.

Figure 4:
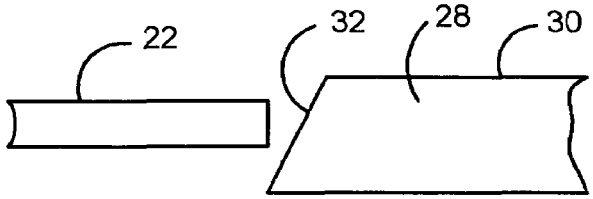
FIG. 4 is a view taken in vertical cross-section showing an interface between a deck and turntable that are part of the de-skewing/weighing/feeding device of FIG. 1.

A circular opening 26 is formed in the deck 22 at a location near the registration wall 24. A rotary disk or turntable 28 is mounted in the opening 26. The disk 28 has a generally horizontal and circular top surface 30. The top surface 30 of the disk 28 may have a powder or rubber coating (not separately shown) thereon to enhance frictional interaction between the top surface 30 and a mailpiece (not shown in FIG. 1) which comes into contact with the top surface 30. A chamfer 32 (FIG. 4) is provided on the disk 28 at the interface of the disk 28 with the deck 22. The top surface 30 of the disk 28 may be raised a small distance (for example, one-thirty-second to one-sixteenth of an inch) above the deck 22.

Figure 8:
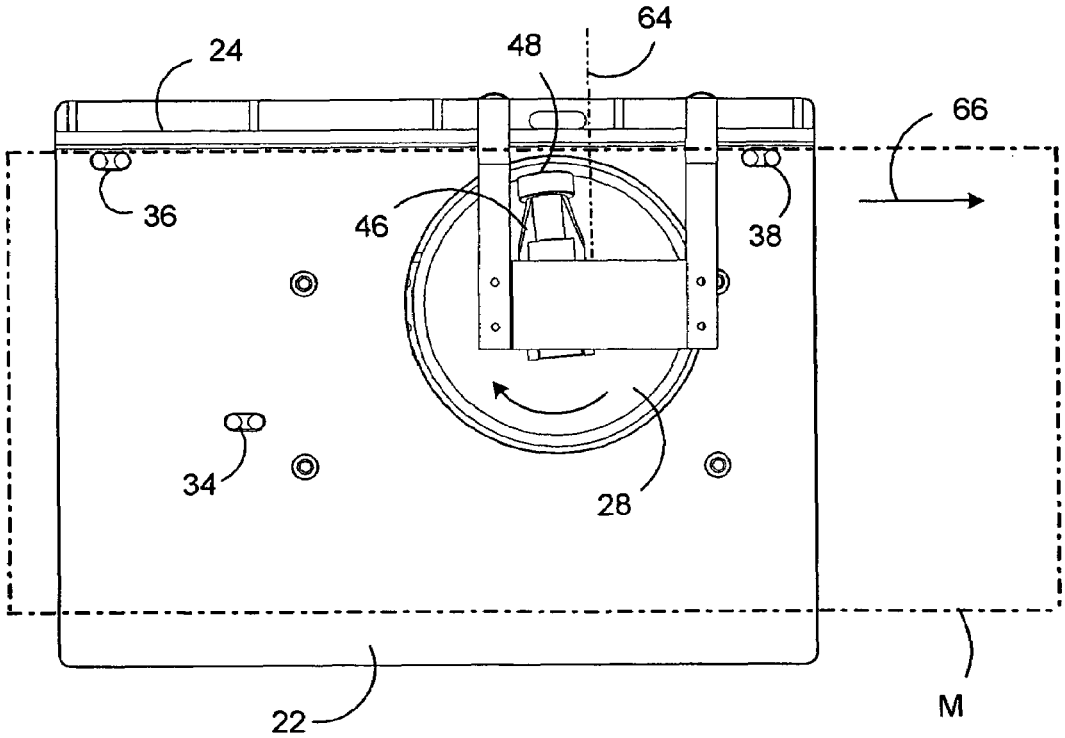

Sensors 34, 36, 38 (FIG. 8) are mounted in the deck 22. Each of the sensors may be an optical sensor that provides an output when an object such as a mailpiece M (FIGS. 7-10) covers the sensor. Sensor 34 is spaced some distance (for example, about 3 inches) from the registration wall 24. Sensor 36 is adjacent one end of the registration wall 24 and sensor 38 is adjacent the opposite end of the registration wall 24.

A nip assembly 40 is adjacent the registration wall 24 and overhangs the disk 28. The nip assembly 40 includes two supports 42 that hold a chassis 44 above the disk 28. A pivot arm 46 is mounted on the chassis 44 above the disk 28 and is pivotable in a horizontal direction with an axis of pivoting that substantially coincides with the axis of rotation of the disk 28. A steer roller 48 is mounted on the free end of the pivot arm 46. The steer roller 48 may be an idler roller or a fixed roller. The roller may be mounted in a ball bearing arrangement (not separately shown). The pivot arm 46 may include a spring loading mechanism (not shown) to bias the steer roller 48 into contact with the top surface 30 of the disk 28. Thus the roller 48 forms a nip with the disk 28. A servo motor 50 (shown partially and in phantom) is mounted in the chassis 44 to selectively impart pivoting motion to the pivot arm 46. As will be seen, pivoting of the pivot arm 46 re-positions the nip formed by the roller 48 and the disk 28 to various circumferential locations relative to the opening 26 in the deck 22. The servo motor may, for example, be a model HS322HD or HS425BB available from Hitec RCD USA, Inc., Poway, Calif.

Figure 2:
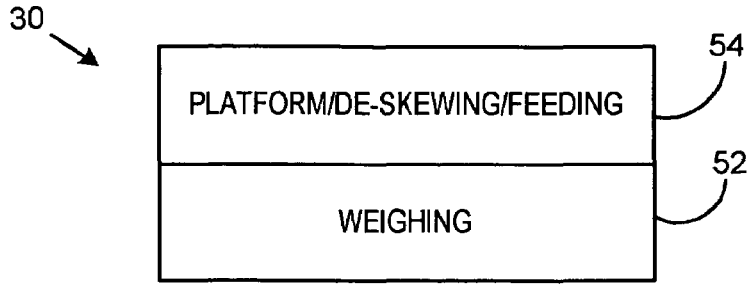
FIG. 2 is a schematic elevational view of the de-skewing/weighing/feeding device of FIG. 1.

FIG. 2 is a schematic elevational view of the de-skewing/weighing/feeding device 20. As seen from FIG. 2, the device includes a weighing module 52 which supports the upper portion of the device shown in FIG. 1. The upper portion, represented schematically by block 54, serves as a scale platform and performs de-skewing and feeding functions to be described below. The weighing module 52 may include a conventional load cell (not separately shown) which provides a signal to indicate the weight of a mailpiece (not shown in FIGS. 1 and 2) supported on the deck 22. The weighing module 52 may generally operate in accordance with conventional practices and therefore does not require further description.

Figure 3:
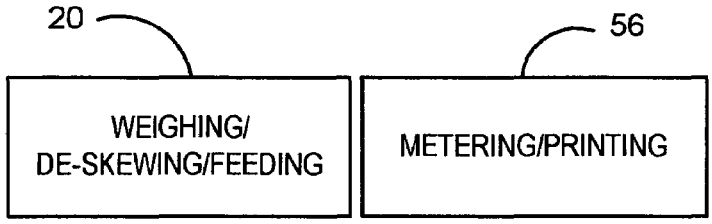
FIG. 3 is a schematic plan view showing the de-skewing/weighing/feeding device of FIG. 1 adjacent a postage metering/printing device to which the de-skewing/weighing/feeding device feeds mailpieces.

FIG. 3 is a schematic plan view showing the de-skewing/weighing/feeding device 20 adjacent a postage metering/printing device 56 to which the de-skewing/weighing/feeding device 20 feeds mailpieces. By a data connection which is not shown, the weighing module 52 may supply mailpiece weight data to a control module (not separately shown) of the metering/printing device 56. The control module for the metering/printing device 56 may be integrated with or separate from the printing components of the device 56. The metering/printing device 56 may accept mailpieces fed one-at-a-time from the de-skewing/weighing/feeding device 20 and may print postage indicia thereon in accordance with weight data for the mailpieces provided by the aforementioned weighing module 52 (FIG. 2) of the device 20. The metering/printing device 56 may operate in accordance with conventional principles. As used herein and in the appended claims, "postage meter" will be understood to refer to any device that operates to print a postage indicium on a mailpiece.

Figure 5:
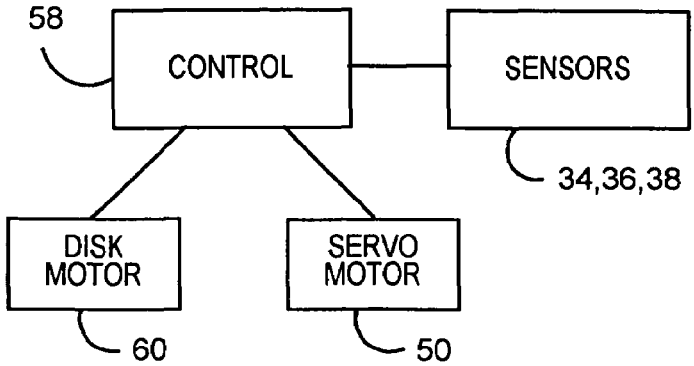
FIG. 5 is a block diagram which illustrates some electrical, electronic and electromechanical components of the de-skewing/weighing/feeding device of FIG. 1.

FIG. 5 is a block diagram which illustrates some electrical, electronic and electromechanical components of the de-skewing/weighing/feeding device 20.

In FIG. 5, block 58 represents a control circuit that controls at least the mailpiece handling operations of the device 20. In some embodiments the control circuit 58 may be integrated with the circuitry that controls operation of the weighing module 52 (FIG. 2). The control circuit 58 may, for example, be constituted by an integrated circuit (not otherwise shown), such as a general purpose microprocessor, mounted on a circuit board (not shown) that may be horizontally oriented and mounted below the deck 22.

Continuing to refer to FIG. 5, block 50 represents the above-mentioned servo motor for the pivot arm 46 (FIG. 1) and block 60 represents a reversible electric motor for rotating the disk/tumtable 28. Both motors are connected to the control circuit 58 by signal paths so that the control circuit 58 is able to control operation of the motors. (Motor driver circuits, which are not shown, may form part of the connections between the control circuit 58 and the motors 50, 60.)

Further, sensors 34, 36, 38 are connected to the control circuit 58 by respective signal paths so that the sensors are each able to provide a respective input to the control circuit to indicate that the respective sensor is covered by a mailpiece.

Figure 6A:
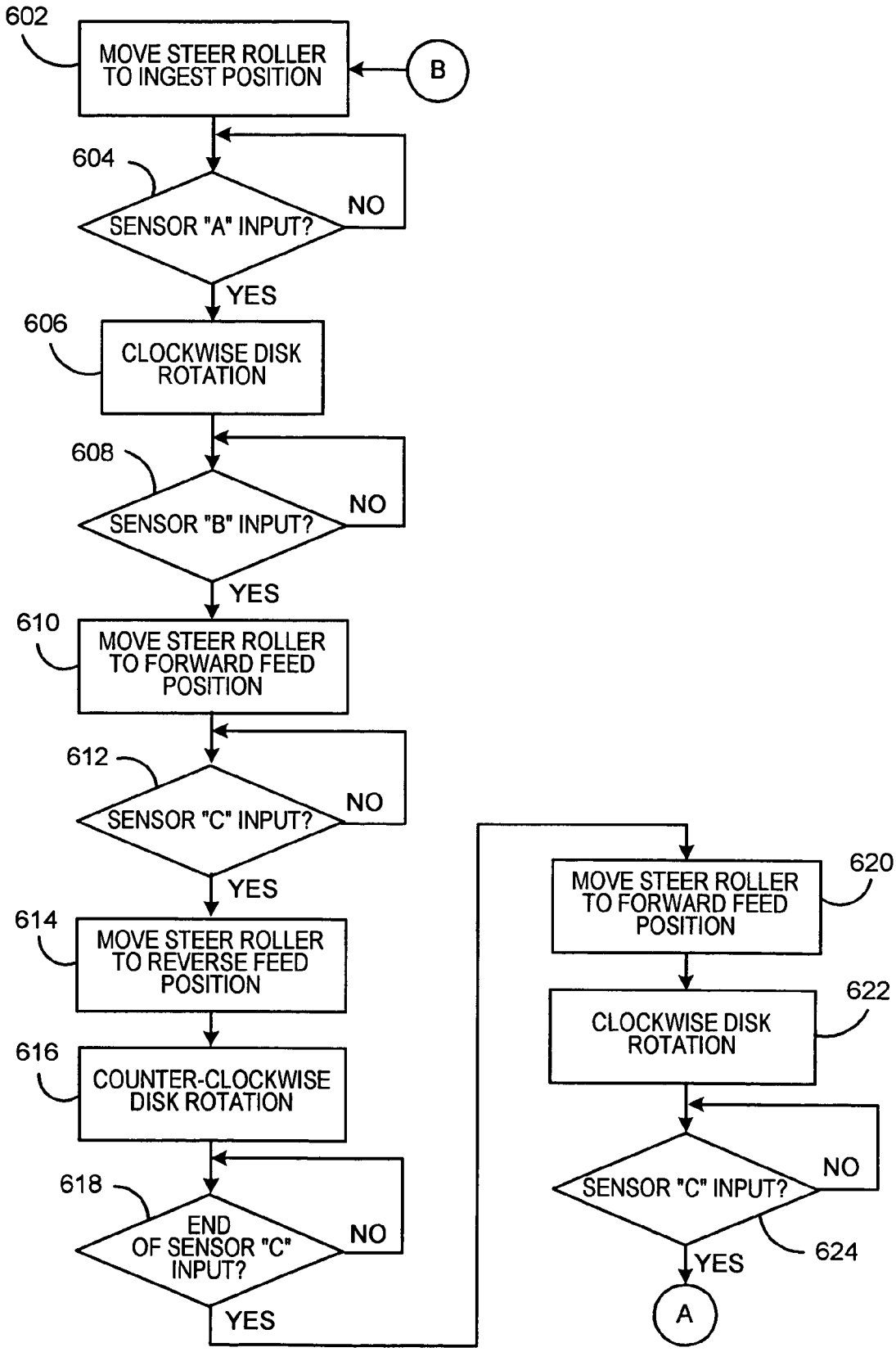
FIGS. 6A and 6B together form a flow chart that illustrates operation of a control circuit that is shown in FIG. 5.
Figure 6B:
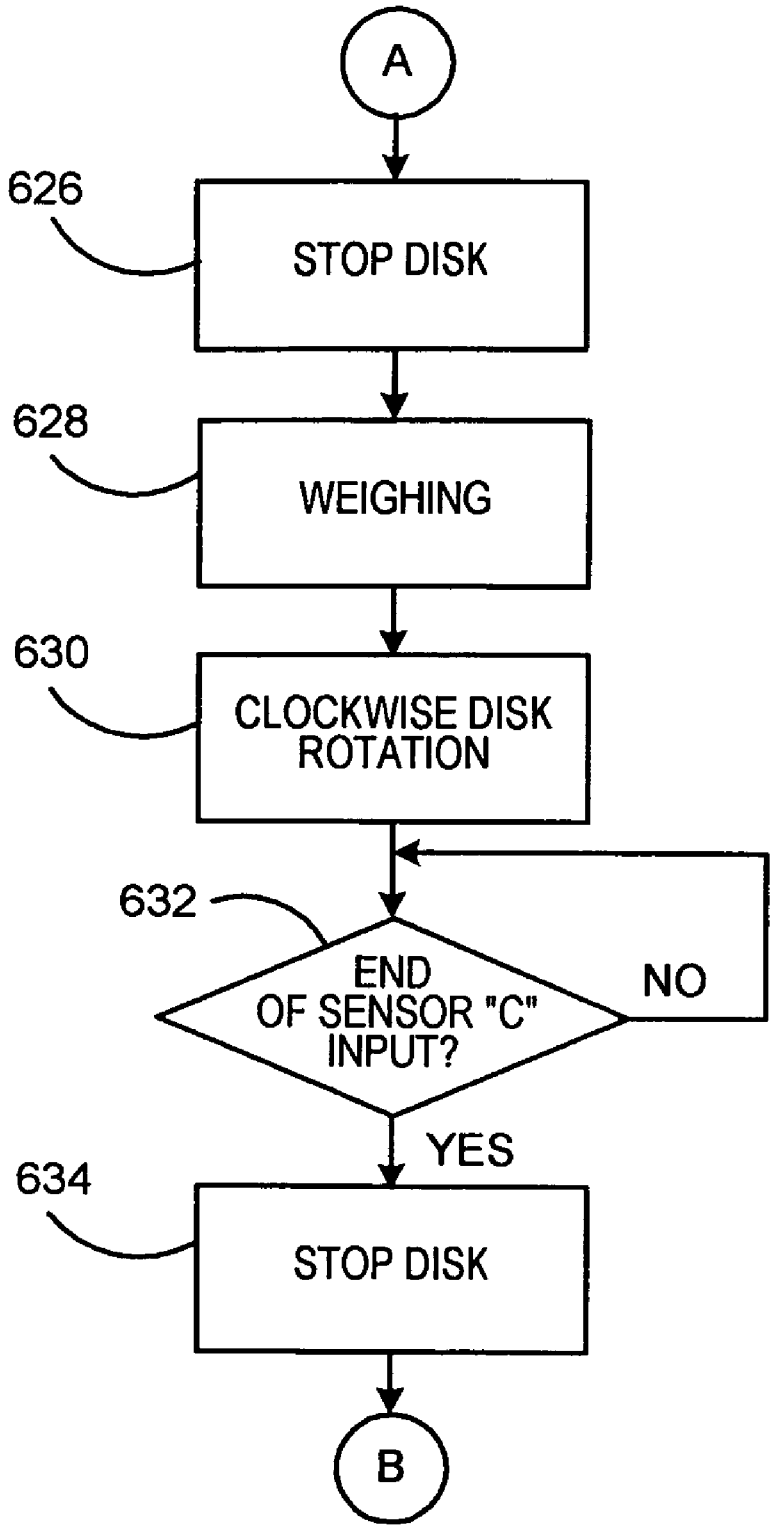
Figure 7:
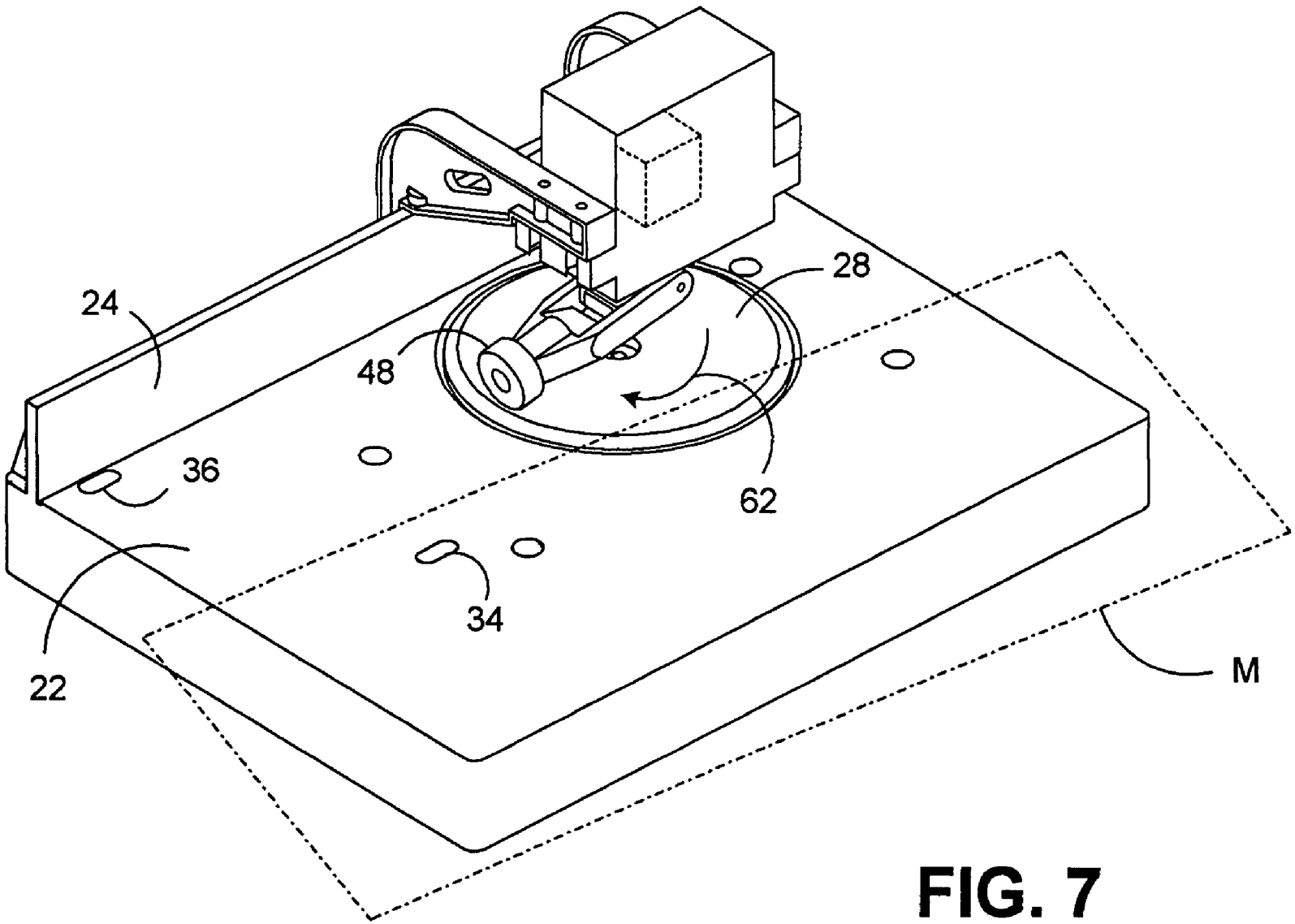
FIGS. 7-10 illustrate stages of operation of the de-skewing/weighing/feeding device of FIG. 1, with FIG. 7 being a perspective view and FIGS. 8-10 being plan views.

FIGS. 6A and 6B together form a flow chart that illustrates operation of the control circuit 58 and consequently also illustrates operation of the de-skewing/weighing/feeding device 20.

At the start of the process illustrated in FIGS. 6A and 6B, the device is in a stand-by condition (illustrated in FIG. 1 and represented by block 602 in FIG. 6A). In the stand-by condition, the device is ready to ingest a mailpiece for de-skewing, weighing and feeding to the postage meter. In the stand-by condition, the pivot arm 46 is positioned as indicated in FIG. 1, and is oriented substantially parallel to the registration wall 24 so that the nip formed by the steer roller 48 and the disk 28 is spaced from the registration wall 24. The disk 28 may be stationary when the device is in the stand-by condition.

When in the stand-by condition, the control circuit 58 determines, as indicated at 604, whether an input signal is received from sensor 34 (also referred to as sensor "A") to indicate that a mailpiece M (FIG. 7) has been deposited on the deck 22. If such an input is received, then the control circuit 58 controls the disk motor 60 to cause the disk 28 to rotate in a clockwise direction (block 606 in FIG. 6A), as indicated by arrow 62 in FIG. 7. Frictional contact between the top surface of the disk 28 and the mailpiece M cause the mailpiece M to be ingested by the nip formed by the roller 48 and the disk 28. The nip then propels the mailpiece toward the registration wall 24.

The control circuit 58 then determines, as indicated at 608, whether an input signal is received from sensor 36 (also referred to as sensor "B") to indicate that a corner of the mailpiece has reached the registration wall 24. If such an input is received, then the control circuit 58 controls the servo motor 50 to cause the pivot arm 46 to be pivoted (block 610 in FIG. 6A) in the clockwise direction to a position shown in FIG. 8. This position is referred to as the forward feed position. In the forward feed position, the steer roller 48 is adjacent the registration wall 24 and the pivot arm 46 is angularly displaced by a small amount in the counter-clockwise direction from a line 64 that is normal to the registration wall. With the steer roller so positioned, and the disk continuing to rotate in the clockwise direction, the nip formed by the steer roller and the disk tends to apply a de-skewing action to the mailpiece so as to align an edge of the mailpiece with the registration wall, while also feeding the mailpiece in the direction indicated by the arrow 66.

Figure 9:
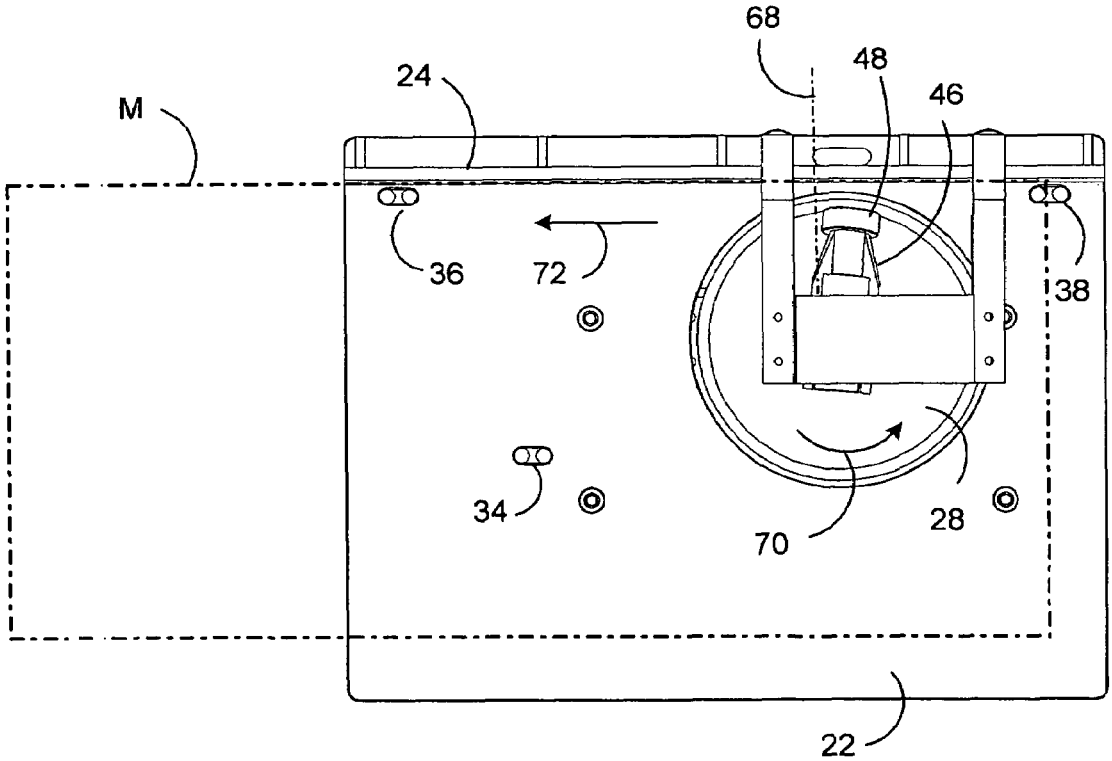
Figure 10:
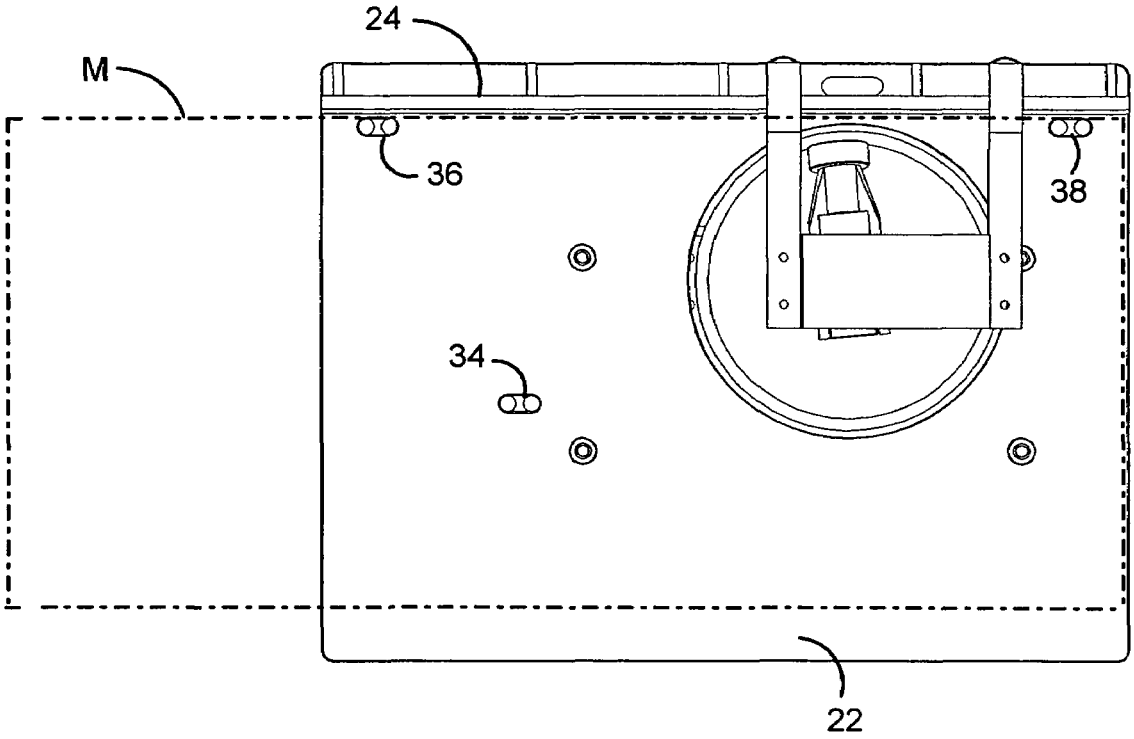

The control circuit 58 then determines, as indicated at 612, whether an input signal is received from sensor 38 (also referred to as sensor "C") to indicate that the leading edge of the mailpiece has covered sensor 38. If such an input is received, then the control circuit momentarily stops the disk 28 and controls the servo motor 50 to cause the pivot arm 46 to be pivoted (block 614 in FIG. 6A) a small amount in the clockwise direction to a position shown in FIG. 9. This position is referred to as the reverse feed position. In the reverse feed position, the steer roller 48 is adjacent the registration wall 24 and the pivot arm 46 is angularly displaced by a small amount in the counter-clockwise direction from the line 68 (shown in FIG. 9) that is normal to the registration wall. The control circuit 58 then controls the disk motor to cause the disk to rotate in the counter-clockwise direction (indicated by arrow 70 in FIG. 9, and this control step indicated by block 616 in FIG. 6A). With the steer roller positioned as shown in FIG. 9, and the disk rotating counter-clockwise, the nip formed by the steer roller and the disk tends to apply de-skewing to the mailpiece while feeding the mailpiece in the direction indicated by the arrow 72 (i.e., in a reverse direction that is opposite to the forward feed direction indicated by arrow 66 in FIG. 8).

The control circuit 58 then determines, as indicated at 618, whether the input signal received from sensor 38 has terminated, to indicate that the (formerly) leading edge of the mailpiece has been moved sufficiently in the reverse direction to uncover sensor 38. If such input is received, then the control circuit momentarily stops the disk and controls the servo motor (as indicated at 620 in FIG. 6A) to return the pivot arm to the forward feed position. The control circuit then controls the disk motor to again rotate the disk in the clockwise direction (block 622) until sensor 38 is again covered (as determined as 624), and then the disk is stopped (block 626, FIG. 6B). This leaves the mailpiece in the position shown in FIG. 10, with its inboard edge aligned with the registration wall and with the mailpiece in a stable position for weighing.

Weighing then occurs, as indicated at 628 in FIG. 6B. (From previous discussion it will be recognized that the resulting weight data may be transmitted from the device 20 to the postage meter.)

Upon completion of weighing, the control circuit 58 controls the disk motor to cause the disk to rotate in the clockwise direction (block 630 in FIG. 6B). Consequently, the mailpiece is fed from the deck 22 to the metering/printing device (FIG. 3, not shown in FIG. 10) to the right of the de-skewing/weighing/feeding device 20. The clockwise disk rotation, and resulting feeding of the mailpiece, continues until the control circuit determines at 632 that the input signal from sensor 38 has terminated, to indicate that the trailing edge of the mailpiece has cleared the sensor 38. The control circuit then stops the disk rotation (block 634 in FIG. 6B), and causes the pivot arm to be pivoted back to the ingest position shown in FIG. 1. Thus the device 20 is again in the stand-by condition (block 602, FIG. 6A) and is ready to receive and ingest another mailpiece. It will be appreciated that the mailpiece fed from the device 20 to the metering/printing device may be processed by the metering/printing device so as to have a postage indicium printed on the mailpiece.

In a practical embodiment of the device 20, the entire process cycle illustrated in FIGS. 6A-6B may take place in no more than a few seconds, so that the operator can quickly, and without great effort, process a considerable number of mailpieces for mailing in a relatively short time.

In some embodiments, the deck may have dimensions of about 7 inches (along the registration wall) by 4¾ inches. A device of this size may be suitable for handling standard size business correspondence envelopes, as well as envelopes up to 6 in. by 10 in. For handling larger mailpieces, a device having a larger deck may be provided. In some embodiments, two rotating disks may be provided, each with a respective pivot arm assembly to cooperate with the respective disk.

In some embodiments, one or more pressure sensors (e.g., a load cell) or the like may be associated with the registration wall as an alternative to one or more of the optical sensors for the purpose of determining that the mailpiece is in contact with the registration wall.

In some embodiments, the steer roller may be replaced with a sphere or other suitably shaped member to serve as a nip member or steering member in place of the steer roller. The nip member, whether or not roller shaped, may be weighted rather than spring-loaded, and may be fixed to the pivot arm (i.e., not rotatable like an idler roller).

Figure 11:
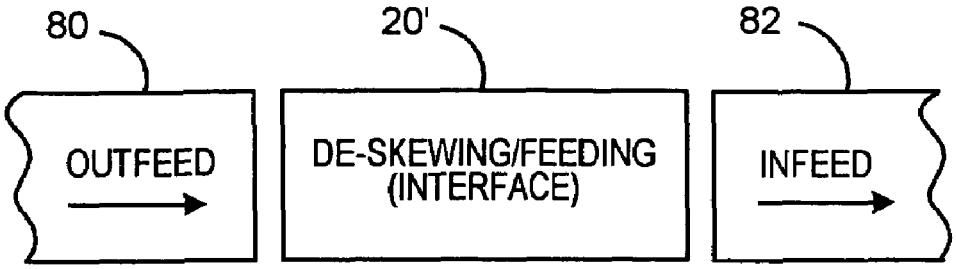
FIG. 11 is a schematic plan view showing a de-skewing and feeding device that serves as an interface between two mailpiece processing devices in accordance with another embodiment of the invention.
Figure 12:
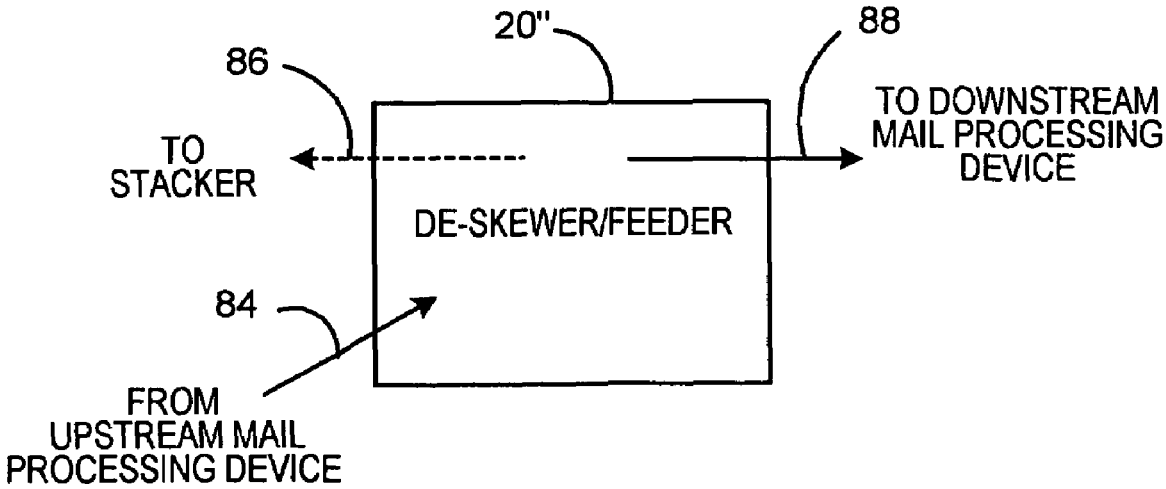
FIG. 12 is a schematic plan view that illustrates operation of a de-skewing and feeding device in accordance with still another embodiment of the invention.

In the embodiments described above, the device 20 was utilized as a hand-fed weighing and intake device for a postage metering system. In other embodiments, the weighing components of the device may be dispensed with and the resulting modified mailpiece handling device 20' may be employed as an interface between two mailpiece processing devices. Such an embodiment is schematically illustrated in FIG. 11, in which a device 20' is located between the outfeed end of a mailpiece processing device 80 and the infeed end of another mailpiece processing device 82. For example, the mailpiece processing device 80 may be an inserter, and the mailpiece processing device 82 may be an address printer. The de-skewing and feeding capabilities of the device 20' may be like those described above with reference to FIGS. 1-10 and may allow mailpieces outfed one by one from device 80 onto the deck of the device 20' to be reliably infed by device 20' to device 82. The feeding of the mailpieces from the device 80 need not be in line with the feed path between the devices 20', 82, but rather may be at an angle, as indicated at 84 in FIG. 12. Moreover, the device 20' may be modified so that it is selectively operable to offload mailpieces (as indicated at 86 in FIG. 12) to a stacker (not shown) in the opposite direction from the normal offloading (indicated at 88) to the downstream device. For example, the control circuit of the de-skewer/feeder 20" may be in communication with a controller for the downstream device and may respond to a signal indicative of a jam in the downstream device. In response to the jam signal, the de-skewer/feeder 20" may change its outfeed direction from 88 to 86 to stack up a residual sequence of a few mailpieces outfed from the upstream device before the upstream device shuts down in response to the jam in the downstream device.

The words "comprise," "comprises," "comprising," "include," "including," and "includes" when used in this specification and in the following claims are intended to specify the presence of stated features, elements, integers, components, or steps, but they do not preclude the presence or addition of one or more other features, elements, integers, components, steps, or groups thereof.

A number of embodiments of the present invention have been described. Nevertheless, it will be understood that various modifications may be made without departing from the spirit and scope of the invention. Accordingly, other embodiments are within the scope of the following claims.

What is claimed is:

1. A mailpiece handling device, comprising:

a substantially horizontal deck for receiving a mailpiece;

a substantially vertical registration wall extending upwardly from an edge of said deck;

a disk mounted for rotation in a circular opening in said deck adjacent said registration wall, said disk having a substantially horizontal surface;

a first sensor mounted in said deck adjacent a first end of said registration wall;

a second sensor mounted in said deck adjacent a second end of said registration wall, said second end opposite said first end;

an arm mounted parallel to and above said disk, said arm having a fixed location and a free end, said free end being pivotable in a horizontal direction around said fixed location;

a steering member mounted at said free end of said arm, said steering member forming a nip with said disk, said nip being repositionable to a plurality of different locations on said disk by pivoting of said arm, said nip for applying downward pressure to a mailpiece such that said mail piece is in contact with said disk, and a control device for controlling location of said nip, a first nip location causing said mailpiece to move along said deck in a first mailpiece direction substantially toward said registration wall when said disk is rotated in a first rotation direction until said mailpiece is detected by said first sensor, said control unit in response to said mailpiece being detected by said first sensor moving said nip to a second nip location to cause said mailpiece to move along said deck in a second mailpiece direction substantially parallel with said registration wall when said disk is rotated in said first rotation direction until said mailpiece is detected by said second sensor, said control unit in response to said mailpiece being detected by said second sensor moving said nip to a third nip location to cause said mailpiece to move along said deck in a third mailpiece direction substantially parallel with said registration wall when said disk is rotated in a second rotation direction opposite said first rotation direction, said third mail piece direction being substantially opposite said second mail piece direction.

2. The mailpiece handling device according to claim 1, further comprising:

a first motor for rotating said disk; and a servo motor for pivoting said arm.

3. The mailpiece handling device according to claim 2, wherein said control device is coupled to said first motor and said servo motor for controlling said first motor and said servo motor.

4. The mailpiece handling device according to claim 3, wherein said control device selectively controls said first motor to selectively rotate said disk in said first rotation direction and said second rotation direction.

5. The mailpiece handling device according to claim 1, further comprising:

weighing means, supporting said deck, for weighing said mailpiece when said mailpiece is on said deck.

* * * * *